US007397227B2

(12) United States Patent
Ke et al.

(10) Patent No.: US 7,397,227 B2
(45) **Date of Patent: *Jul. 8, 2008**

(54) FAST-DISABLED VOLTAGE REGULATOR CIRCUIT WITH LOW-NOISE FEEDBACK LOOP AND OPERATING METHOD THEREOF

(75) Inventors: Ling-Wei Ke, Hsin-Chu Hsien (TW); Chi-Kun Chiu, Ping-Cheng (TW)

(73) Assignee: MediaTek Inc., Hsin-Chu Hsien (TW)

( * ) Notice: Subject to any disclaimer, the term of this patent is extended or adjusted under 35 U.S.C. 154(b) by 146 days.

This patent is subject to a terminal disclaimer.

(21) Appl. No.: 11/383,763

(22) Filed: May 17, 2006

(65) Prior Publication Data

US 2006/0214651 A1 Sep. 28, 2006

Related U.S. Application Data

(63) Continuation-in-part of application No. 10/711,618, filed on Sep. 29, 2004, now Pat. No. 7,109,690.

(30) Foreign Application Priority Data

Oct. 1, 2003 (TW) ..... 92127228 A

(51) Int. Cl.
*G05F 1/575* (2006.01)

(52) U.S. Cl. ..... 323/273

(58) Field of Classification Search ..... 323/273, 323/349

See application file for complete search history.

(56) References Cited

U.S. PATENT DOCUMENTS

| | | | | |
|---|---|---|---|---|
| 4,962,349 | A | 10/1990 | Albach et al. | |
| 5,015,921 | A | 5/1991 | Carlson et al. | |
| 5,528,132 | A | 6/1996 | Doluca | |
| 5,861,737 | A | 1/1999 | Goerke et al. | |
| 6,177,785 | B1 | 1/2001 | Lee | |
| 6,362,609 | B1 | 3/2002 | Gailhard | |
| 6,414,537 | B1 | 7/2002 | Smith | |
| 7,109,690 | B2 * | 9/2006 | Ke et al. | 323/273 |

* cited by examiner

*Primary Examiner*—Jeffrey L Sterrett
(74) *Attorney, Agent, or Firm*—Winston Hsu

(57) ABSTRACT

A low-noise voltage regulator circuit with quick disablement includes an amplifier for outputting a driving voltage according to a reference voltage, a feedback voltage on a feedback node, and an enable signal; an output transistor coupled among the amplifier, an output node, and a first voltage source for outputting an output voltage at the output node; a first discharge transistor having a first size and coupled among the enable signal, the output node, and the feedback node; and a second discharge transistor having a second size being different than the first size and coupled among the enable signal, the feedback node, and a second voltage source; wherein when the enable signal disables the amplifier, the enable signal turns on the first discharge transistor and the second discharge transistor such that the output voltage is quickly pulled down to close a level provided by the second voltage source.

24 Claims, 5 Drawing Sheets

FAST-DISABLED VOLTAGE REGULATOR CIRCUIT WITH LOW-NOISE FEEDBACK LOOP AND OPERATING METHOD THEREOF

CROSS REFERENCE TO RELATED APPLICATIONS

This is a continuation-in-part of U.S. application Ser. No. 10/711,618 entitled, "Fast-Disabled Voltage Regulator Circuit with Low-Noise Feedback Loop and Operating Method Thereof", which was filed on Sep. 29, 2004 and is included herein by reference.

BACKGROUND

The present invention provides a low-noise voltage regulator circuit and an operating method thereof for quickly disabling the voltage regulator circuit, and more particularly, to a low-noise voltage regulator circuit and an operating method thereof that utilize an enable signal for connecting an output node, through a feedback node, to a ground voltage source so as to quickly pull down the output voltage of the low-noise voltage regulator circuit.

In all kinds of electrical products on the market, a voltage regulator circuit is often used to execute the work of voltage regulation and to provide a stable voltage to other circuit modules in the electrical product. For example, in many micro-controller systems, used for providing a different bias between the I/O circuit and the other core circuit which is used to execute numeral operations and data management, a voltage regulator circuit often provides a bias to the I/O circuit and the core circuit according to the direct voltage and the output voltage. Please refer to FIG. 1. FIG. 1 is a diagram of a related art voltage regulator circuit. An external device is connected to the voltage regulator circuit shown in FIG. 1 (ex. the above-mentioned core circuit). The related art voltage regulator circuit 10 comprises an amplifier circuit 12, an output transistor 14, and a loading module 16. The loading module 16 comprises a loading capacitor CL and two loading resistors RL1, RL2. The loading capacitor CL and these two loading resistors RL1, RL2 are connected to an output node NOUT and a second voltage source VSS. The second voltage source VSS typically provides a low DC voltage or a ground voltage. The amplifier circuit 12 comprises a first receiving terminal Na1 and a second receiving terminal Na2. The first and second receiving terminals Na1, Na2 are commonly regarded as two differential input terminals. The first receiving terminal Na1 is electrically connected to a reference voltage generator 13 for receiving a reference voltage, and the second receiving terminal Na2 is electrically connected to a feedback node NF1 for receiving a feedback voltage. The reference voltage is generated from the reference voltage generator 13. The amplifier circuit 12 outputs a driving voltage to the output transistor 14 through the output terminal Np1 for controlling the bias of the gate of the output transistor 14 according to the reference voltage, the feedback voltage, and an enable signal ENABLE.

In this related art embodiment, the output transistor 14 is designed to be a P-channel MOS (PMOS) transistor. The gate of the output transistor 14 is electrically connected to the amplifier circuit 12 through the node Np1, the drain of the output transistor 14 is electrically connected to the output node NOUT, and the source of the output transistor 14 is electrically connected to a first voltage source VCC. The first voltage source VCC provides a high DC voltage for this system. For example, if the voltage regulator circuit is applied to a micro-controller system, the first voltage source VCC is set as a DC voltage of 3.3V. It means that the DC voltage 3.3V is the DC bias, which is provided to the micro-controller system and the voltage regulator circuit 10. The external devices 18 needs to be biased at a lower voltage, for example, 2.5V. So the task of the voltage regulator circuit 10 is to utilize the DC voltage 3.3V (the first voltage source VCC) to generate a steady output voltage 2.5V on the output node NOUT for the external devices 18. Referring to FIG. 1 again, the output node NOUT is connected to the loading capacitor CL, which has a fixed capacitor value. The loading capacitor CL can be used to regulate the output voltage and suppress the noise. When the loading capacitor is charged to serve as a steady state, it can establish a steady-state output voltage. The output voltage is provided to the external devices 18 as a bias voltage. On the other hands, a feedback voltage on the feedback node NF1 is generated by dividing the output voltage based on the two loading resistors RL1, RL2. The feedback voltage is then fed back to the amplifier circuit 12.

The related art driving operation of the voltage regulator circuit 10 is described as follows. The first voltage source VCC provides a high DC voltage to the voltage regulator circuit 10 while the second voltage source VSS provides a low DC voltage to the voltage regulator circuit 10. After the enable signal ENABLE provides a high DC voltage to the amplifier circuit 12, the amplifier circuit 12 and the voltage regulator circuit 10 is enabled. In steady state, the amplifier circuit 12 will typically output a low driving voltage to the gate of the output transistor 14 through the output node Np1 such that the first voltage source VCC and the output node NOUT are connected. In the very beginning, the voltage between the source and drain of the output transistor 14 almost equal to the voltage difference of the DC voltage VCC and VSS, and therefore conducts a large current from the source to the drain, which in turn charges the loading capacitor CL. During the charging process, the output voltage on the output node NOUT will be increased until reaching a steady state level. When it reaches the steady state, the amplifier circuit 12 would have the feedback voltage equal to the reference voltage. The steady output voltage can thus be supplied to the external devices 18. Once the output voltage somehow varies, the amplifier circuit will generate an appropriate driving voltage for regulating the output voltage.

When disabling the operation of the related art voltage regulator circuit 10, the enable signal ENABLE is changed to provide, say, a low DC voltage to the amplifier circuit 12. The enable signal ENABLE with a low voltage level will stop the operation of the amplifier circuit 12 and force the amplifier circuit 12 to output a high driving voltage to the gate of the output transistor 14. Because the output transistor 14 is a PMOS transistor, the high driving voltage turns off the output transistor 14, and the connection between the first voltage source VCC and the output node NOUT is broken. It means that the first voltage source VCC no longer provides a high DC voltage to the output node NOUT. In such a case, the voltage regulator circuit 10 starts to discharge itself through the loading module. However, the loading capacitor CL leads to a finite duration of the discharging time, which implies that the voltage regulator circuit 10 is not only disabled slowly but also not able to provide a precise and stable output voltage. Moreover, the increase of the discharging time implies an increase in power consumption as well as the inability to disable the output voltage precisely and promptly. Therefore, the related art voltage regulator circuit 10 has its drawbacks while be used in the portable electronic systems (ex. notebooks and PDAs) where low power consumption and precise and stable controls of the output voltage are of concern.

To solve the above-mentioned problem, a voltage regulator disclosed in the U.S. Pat. No. 6,362,609 speeds up the operation in that the voltage regulator circuit 10 with the basic structure mentioned above stops outputting the output voltage through utilizing an additional transistor added to the voltage regulator circuit 10. The operation of the related circuit has been fully described in the specification of the patent, and the lengthy description is not repeated.

SUMMARY OF THE INVENTION

It is therefore one objective of the claimed invention to provide a low-noise voltage regulator circuit and a related operating method to quickly disable the voltage regulator circuit to solve the above-mention problems.

According to the present invention, the claimed voltage regulator circuit can quickly disable and pull down the feedback voltage of the amplifier circuit. At least two differently sized discharge transistors are added to the prior art voltage regulator circuit to quickly discharge the output voltage of the voltage regulator circuit through the discharge transistor. In addition, at least one bypass capacitor is added to the related feedback input terminal of the amplifier circuit. When filtering out the RF interference signal to reduce noise, the bypass capacitor utilizes the discharge transistor to fast pull down the feedback voltage of the amplifier circuit. It comes to lower the noise and reduce the discharge time. Therefore, the claimed voltage regulator circuit can quickly disable and provide a low-noise, precise, and stable output voltage.

According to a first exemplary embodiment of present invention a voltage regulator circuit is disclosed for outputting at least an output voltage from an output node. The voltage regulator circuit comprises an amplifier circuit comprising a first receiving terminal and a second receiving terminal for receiving a reference voltage and a feedback voltage respectively, the amplifier circuit outputting a driving voltage according to the reference voltage, the feedback voltage, and an enable signal; an output transistor comprising three terminals electrically connected to the amplifier circuit, the output node, and a first voltage source respectively for receiving the driving voltage, the output transistor regulating the output voltage of the output node according to the driving voltage; a first discharge transistor having a first size and comprising three terminals electrically connected to an inverse enable signal, the output node, and a feedback node respectively, the first discharge transistor controlling whether or not the output node is electrically connected to the feedback node according to the inverse enable signal, wherein the output node is electrically connected to the second receiving terminal for providing the amplifier circuit with the feedback voltage; a second discharge transistor having a second size being different than the first size and comprising three terminals electrically connected to the inverse enable signal, the feedback node, and a second voltage source, the first discharge transistor controlling whether or not the feedback node is electrically connected to the second voltage source according to the inverse enable signal; and a loading module electrically connected to the output node, the feedback node, and the second voltage source. In addition, the voltage regulator circuit further has a bypass capacitor electrically connected to the second receiving terminal of the amplifier circuit for filtering out at least an RF interference signal.

In addition, according to a second exemplary embodiment of the present invention, a method to quickly disable a voltage regulator circuit is disclosed. The voltage regulator circuit has an amplifier circuit for outputting a driving voltage according to an enable signal; an output transistor electrically connected to the amplifier circuit, a output node, and a first voltage source for regulating an output voltage of the output node according to the driving voltage; a first discharge transistor having a first size and electrically connected to the enable signal, the output node, and a feedback node; and a second discharge transistor having a second size being different than the first size and electrically connected to the enable signal, the feedback node, and a second voltage source. The method includes (a) utilizing the enable signal to stop the operation of the amplifier circuit for turning off the output transistor to stop the output transistor from outputting an output voltage to the output node; (b) in step (a), utilizing the enable signal for turning on the first discharge transistor to connect the output node and the feedback node so as to quickly pull down the output voltage to a voltage level of the feedback node; and (c) in step (a), utilizing the enable signal for turning on the second discharge transistor to connect the feedback node and the second voltage source so as to quickly pull down the voltage level of the feedback node to a voltage level of the second voltage source. In addition, the method further includes (d) In step (c), quickly pulling down the feedback voltage to the voltage level of the second voltage source when the second discharge transistor is turned on to connect the feedback node and the second voltage source; (e) in step (d), utilizing the bypass capacitor to filter out at lease an RF interference signal; and (f) in step (a), when the enable signal stops the operation of the amplifier circuit, turning on the terminative transistor for quickly turning off the output transistor to stop the output node from being electrically connected to the first voltage source.

The claimed low-noise voltage regulator circuit is based on the structure of the prior art voltage regulator circuit. At least two discharge transistors and a bypass capacitor are added for quickly pulling down the feedback voltage of the amplifier circuit and for quickly discharging the output voltage of the voltage regulator through the discharge transistors. It has a low-noise feedback pull-low mechanism and an ability of fast disabling the operation. In addition, it can further lower the noise and reduce the discharge time and unnecessary power consumption. To sum up, it makes the voltage regulator circuit able to provide a low-noise, precise, and stable output voltage.

These and other objectives of the present invention will no doubt become obvious to those of ordinary skill in the art after reading the following detailed description of the preferred embodiment that is illustrated in the various figures and drawings.

DETAILED DESCRIPTION

Figure 2:
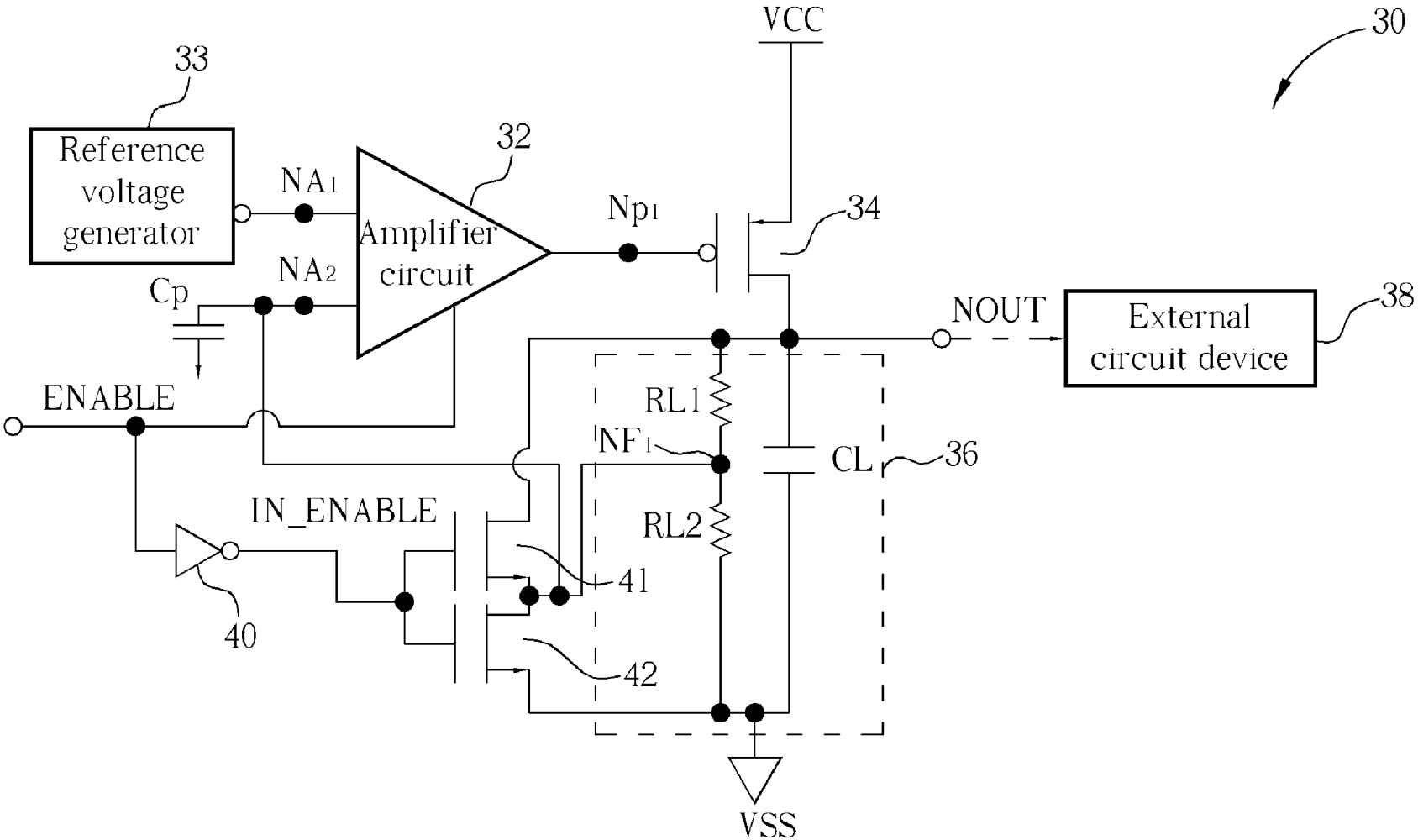
FIG. 2 is a diagram of an embodiment of a voltage regulator circuit according to the present invention.

Technical characteristics of the present invention emphasizes on the operation when a low-noise voltage regulator circuit is disabled. Please refer to FIG. 2. FIG. 2 is a diagram of an embodiment of a low-noise voltage regulator circuit 30 according to the present invention. Please note that the voltage regulator circuit 30 shown in FIG. 2 is built by several MOS transistors and related circuit components. In practical implementation, other transistors, such as BJTs, can also be used to replace MOS transistors. Please refer to FIG. 2, the voltage regulator circuit 30 comprises an amplifier circuit 32, an output transistor 34, an inverter 40, a first discharge transistor 41, a second discharge transistor 42, and a loading module 36. In practical implementation, the amplifier circuit 32 can be an operational amplifier or a differential amplifier. The amplifier circuit 32 comprises an output terminal Np1, a first receiving terminal NA1, and a second receiving terminal NA2. The first receiving terminal NA1 receives a reference voltage, and the second receiving terminal NA2 receives a feedback voltage. The amplifier circuit further receives an enable signal ENABLE to enable or disable its operation. The amplifier circuit 32 outputs a driving voltage on the output terminal Np1 according to the reference voltage, the feedback voltage, and the enable signal ENABLE. As mentioned above, the transistors of this embodiment are MOS transistors. Each transistor has three terminals: a gate, a drain, and a source. The output terminal Np1 of the amplifier circuit 32 is connected to the gate of the output transistor 34, while the drain of the output transistor 34 is electrically connected to an output node NOUT, and the source is electrically connected to a first voltage source VCC. The first voltage source VCC is used to provide a high voltage level, and the output node NOUT is connected to an external circuit device 38 that need a regulated voltage supply. Note that, the "external" is used to indicate that circuit device 38 is an external device with respect to the voltage regulator circuit 30 itself. When the voltage regulator circuit 30 is enabled, the amplifier circuit 32 outputs an appropriate driving voltage to turn on the output transistor 34 and provides an output voltage on the output node NOUT for the external circuit device 38.

The loading module 36 comprises a loading capacitor CL and two loading resistors RL1 and RL2 used as a voltage divider. The loading capacitor CL is connected between the output node NOUT and the second voltage source VSS. Typically, the second voltage source VSS provides a ground voltage or a low voltage level. The first loading resistor RL1 is coupled between the output node NOUT and the node NF1. The second loading resistor RL2 is coupled between the feedback node NF1 and the second voltage source VSS. These two loading resistors RL1 and RL2 act as a voltage divider, hence the voltage on the feedback node NF1 is a value between the output voltage and the voltage provided by the second voltage source VSS. The voltage divided by the first and the second loading resistors RL1, RL2 is then fed back to the amplifier circuit 32. Please refer to FIG. 2 again. The source of the first discharge transistor 41 and the drain of the second discharge transistor 42 are connected to each other on the feedback node NF1 wherein the first discharge transistor 41 and the second discharge transistor 42 are both NMOS transistors. The gate of the first discharge transistor 41 is electrically connected to the inverter 40, and the drain is electrically connected to the output node NOUT. The gate of the second discharge transistor 42 is also electrically connected to the inverter 40, and the source is electrically connected to the second voltage source VSS. The inverter 40 is used to transform the enable signal ENABLE into an inverse enable signal IN_ENABLE and to output the inverse enable signal IN_ENABLE to the first discharge transistor 41 and the second discharge transistor 42. Therefore, the voltage level of the inverse enable signal IN_ENABLE generated by the inverter 40 decides whether the first discharge transistor 41 and the second discharge transistor 42 are turned on or not.

To disable the voltage regulator circuit 30, the enable signal ENABLE provides a low DC voltage to the amplifier circuit 32. Then the amplifier circuit 32 outputs a high driving voltage to the gate of the output transistor 34 through the output node Np1 for turning off the output transistor 34. Hence, the connection between the first voltage source VCC and the output node NOUT is broken, and the voltage on the output node NOUT will not be further maintained. At the same time, the inverter 40 transforms the enable signal ENABLE with a low voltage level into the inverse enable signal IN_ENABLE with a high voltage level, and transfers the inverse enable signal IN_ENABLE to the gates of the first discharge transistor 41 and the second discharge transistor 42. Because the first and the second discharge transistor 41,42 are both NMOS transistors, the inverse enable signal IN_ENABLE with the high voltage level turns on the first discharge transistor 41 to establish a connection between the output node NOUT and the feedback node NF1. At the same time, the second discharge transistor 42 is also turned on, and the feedback node NF1 and the second voltage source VSS are connected so that the feedback voltage on the feedback node NF1 is quickly pulled down to a low voltage level provided by the second voltage source VSS. Because the resistance of the first and the second discharge transistors 41, 42 is much smaller than the loading resistors RL1 and RL2, the output voltage of the output node NOUT will discharge mainly and quickly through the first and the second discharge transistors 41, 42. As a result, it avoids the discharge time delay caused by the RC circuit of the loading module 36, and reduces the discharge time.

Figure 1:
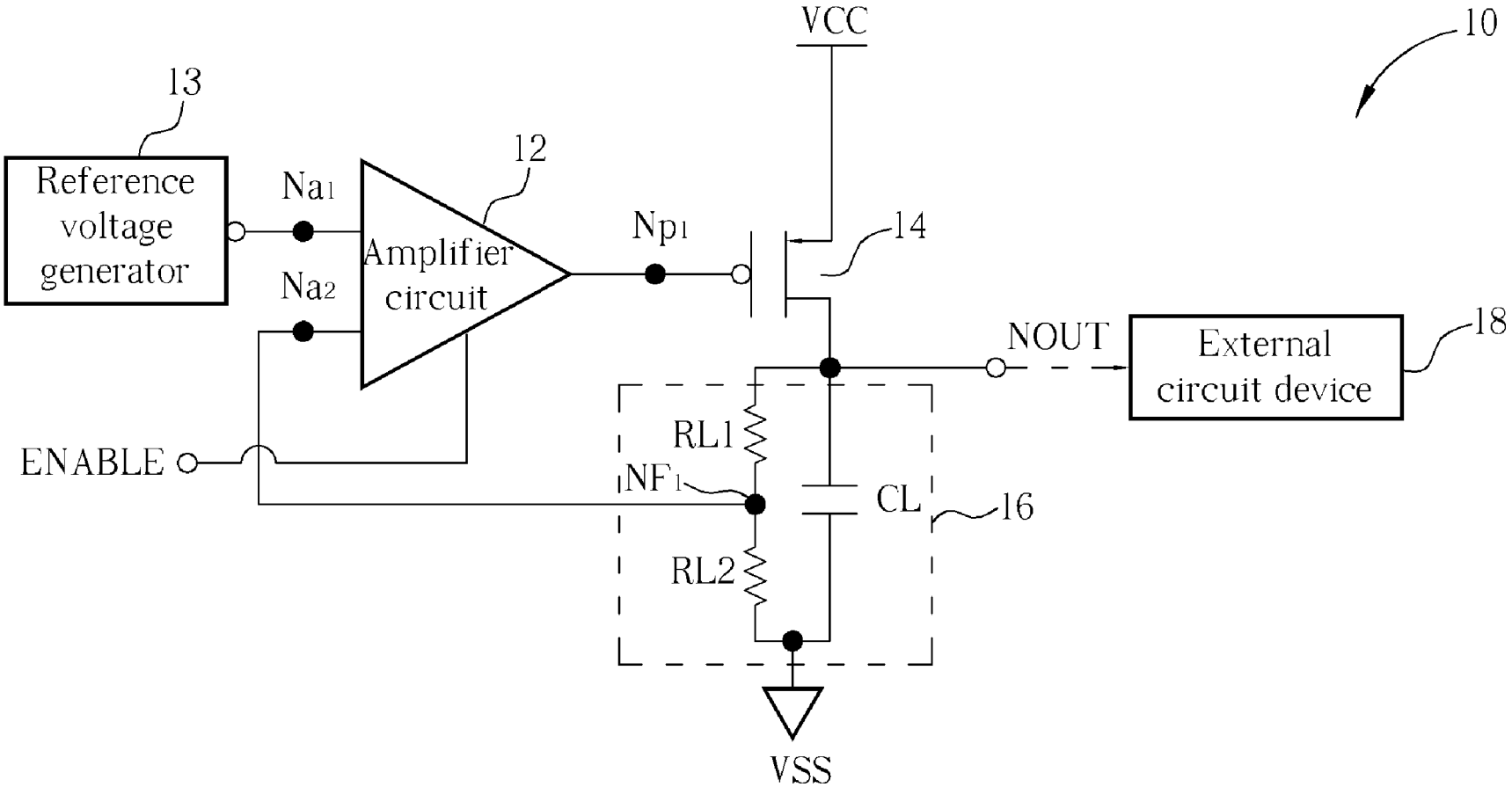
Fig. 1 Related Art
FIG. 1 is a diagram of a prior art voltage regulator circuit.

Please note that in this embodiment of the present invention, two discharge transistors (the first and the second discharge transistors 41, 42) are employed to connect to each other. It can quickly pull down the feedback voltage of the feedback node NF1 and the output voltage of the output node NOUT. It fulfills two technical features: quick disablement and quick pulling down of the feedback voltage of the amplifier circuit 32, both at the same time. Based on the above, when the voltage regulator circuit 30 is disabled, it is the feedback node NF1, not the second voltage source VSS, should be regarded as being connected to the output node NOUT. Please refer to FIG. 2. In order to make the voltage regulator 30 according to the present invention have the technical feature of low-noise feedback, the voltage regulator 30 further comprises a bypass capacitor Cp that is electrically connected to the second receiving terminal NA2 of the amplifier circuit 32 to filter out the noise. Please refer to FIG. 1. If the bypass capacitor Cp is used in the prior art structure, the bypass capacitor Cp will induce serious side effect since it would lower the speed of voltage regulation of the second receiving terminal NA2 and slow down the speed of disabling the prior art voltage regulator circuit 10. Unlike the prior art, the feedback voltage in the voltage regulator circuit 30 according to the present invention shown in FIG. 2 can be quickly pulled down by the second discharge transistor 42, the speed of discharging and the efficiency of disabling are not sacrificed while employing the bypass capacitor Cp to suppress the noise. It allows the voltage regulator circuit 30 according to the present invention to output a low-noise, precise, and stable output voltage.

The bypass capacitor Cp of the present invention is placed at the second input of the amplifier connecting to the loading module in the feedback path, which allows an improvement in the following two aspects:

1. The bypass capacitor Cp can also be quickly discharged through the two transistors 41, 42.

2. Using the bypass capacitor Cp combined with the resistant loading modules in the feedback path further reduces high frequency disturbance, especially when the voltage regulator circuit is implemented with a RF devices, which may be operated at a high frequency.

Therefore, utilizing the combination of two discharge transistors 41, 42 and the bypass capacitor Cp allows the voltage regulator circuit 30 according to the present invention to output a low-noise, precise, and stable output voltage, and reduces high frequency disturbance.

Figure 3:
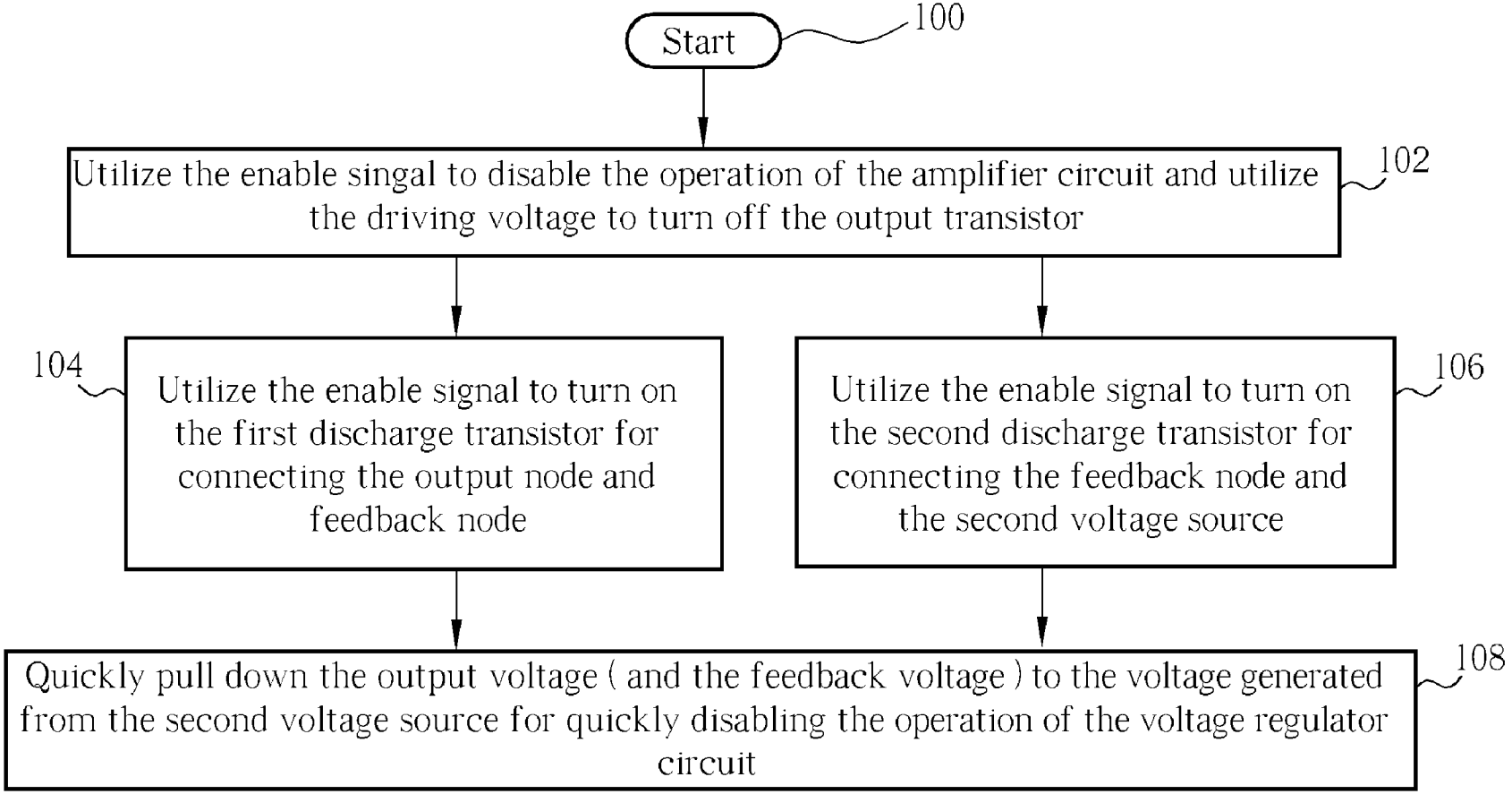
FIG. 3 is a flow chart illustrating the disablement of the voltage regulator circuit shown in FIG. 2.

Based on the voltage regulator circuit 30 of the embodiment shown in FIG. 2 and emphasized on disabling the voltage regulator circuit 30, the implementations of fast disabling the voltage regulator circuit 30 can be concluded as follows. Please refer to FIG. 3. FIG. 3 is a flow chart illustrating the disablement of the voltage regulator circuit 30 shown in FIG. 2.

Step 100: Start to disable the voltage regulator circuit 30;

Step 102: Before disabling the amplifier circuit 32, the voltage regulator circuit 30 typically outputs a steady output voltage to the output node NOUT. To disable the voltage regulator circuit 30, the enable signal ENABLE is set to be a low DC voltage to disable the amplifier circuit 32 such that the amplifier circuit 32 will output a high driving voltage on the node Np1. The high voltage output of the amplifier circuit 32 will then turn off the output transistor 34 (PMOS transistor) and break the connection between the first voltage source VCC and the output node NOUT. Next, go to steps 104 and 106 simultaneously;

Step 104: The inverter 40 transforms the enable signal ENABLE into the inverse enable signal IN_ENABLE (high voltage level) to turn on the first discharge transistor 41 such that the output node NOUT and the feedback node NF1 are connected. At this time, the output voltage is typically very close to the feedback voltage on the feedback node NF1. Go to step 108;

Step 106: The inverse enable signal IN_ENABLE transformed by the inverter 40 turns on the second discharge transistor for connecting the feedback node NF1 and the second voltage source VSS such that the feedback voltage on the feedback node NF1 is quickly pulled down to the voltage generated from the second voltage source VSS. Go to step 108; and Step 108: Based on effects in steps 104 and 106, the output voltage of the output node NOUT is also quickly pulled down toward the voltage of the second voltage source VSS. Therefore, the expected feature of quick disablement of the voltage regulator circuit 30 is fulfilled.

In practical, when the amplifier circuit 32 is disabled by the enable signal ENABLE, the amplifier circuit 32 will need a amount of time period for shifting its original high driving voltage on the node Np1 to a low one. In order to quickly and precisely disable the amplifier circuit 32, it is desired that the driving voltage output by the amplifier circuit 32 can promptly react on the enable signal ENABLE so as to turn off the output transistor 34 as soon as possible.

Figure 4:
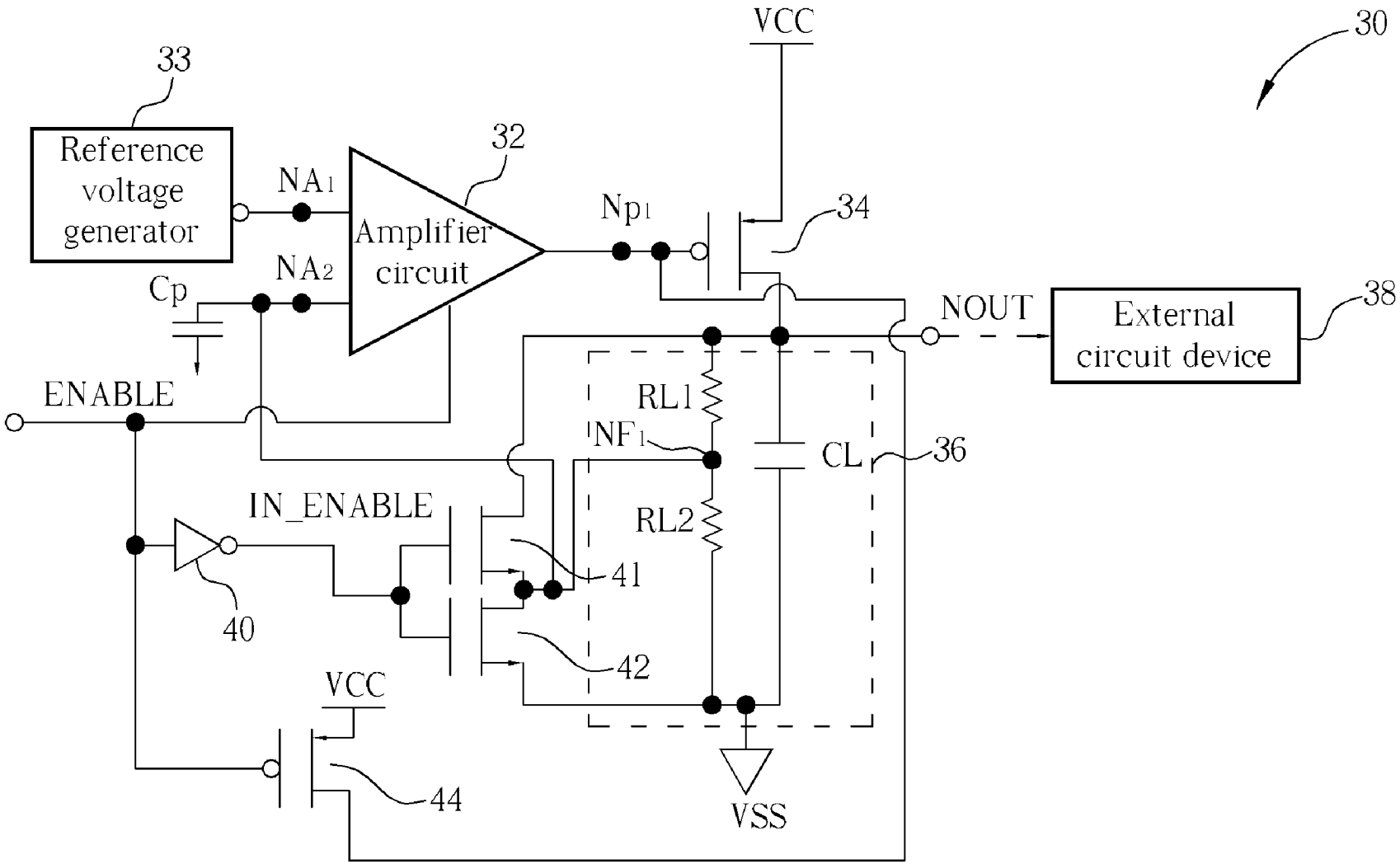
FIG. 4 is a diagram of another embodiment of the voltage regulator shown in FIG. 2.

Please refer to FIG. 4. FIG. 4 is a diagram of another embodiment of the voltage regulator circuit 30 according to the present invention. It basically follows the structure and has the same technical feature of the embodiment shown in FIG. 2. The difference between these two embodiments is that the voltage regulator circuit 30 shown in FIG. 4 contains an additional transistor 44, which is a PMOS transistor in the example. The gate, drain, and source of the terminative transistor 44 are electrically connected to the enable signal ENABLE, the gate of the output transistor 34, and a high voltage source, respectively. In practical implementation, the first voltage source VCC can provide the high voltage level for the terminative transistor 44. In the disclosure of the present invention, the terminative transistor 44 can regulate the driving voltage on the node Np1 according to the enable signal ENABLE. When the enable signal ENABLE has a voltage transition from a high voltage level to a low voltage level for disabling the amplifier circuit 32, the terminative transistor 44 is turned on at the same time to connect the high voltage source to its drain such that the voltage of the gate of the output transistor 34 is quickly pulled up. In another words, the driving voltage is quickly changed from the low voltage level to the high voltage level to quickly turn off the output transistor 34.

Figure 5:
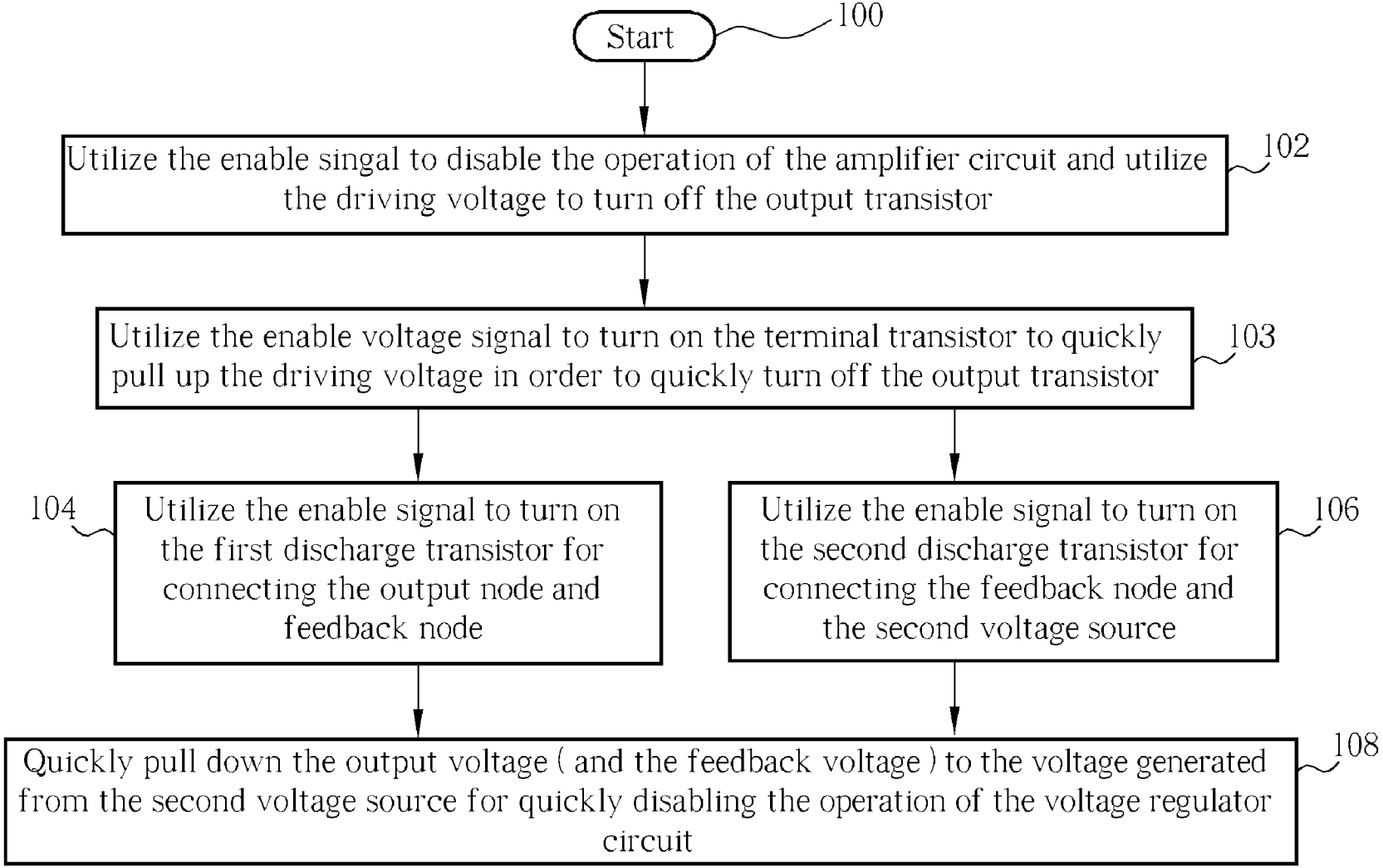
FIG. 5 is a flow chart illustrating the disablement of the voltage regulator circuit shown in FIG. 4.

Therefore, based on the voltage regulator circuit 30 shown in FIG. 4, a corresponding step is added to the flow shown in FIG. 3. Please refer to FIG. 5. FIG. 5 is a flow chart illustrating the disablement of the voltage regulator circuit 30 shown in FIG. 4. The added step is:

Step 103: After the enable signal ENABLE has a voltage transition from the high voltage level to the low voltage level, the enable signal ENABLE with the low voltage level turns on the terminative transistor 44 to quickly pull up the driving voltage in order to quickly turn off the output transistor 34 for breaking the connection between the output node NOUT and the first voltage source VCC.

In addition, in the actual embodiment, the number of the discharge transistors is not limited and can be increased by the designer. According to the embodiments mentioned above, the low-noise voltage regulator circuit according to the present invention is disclosed. At least two discharge transistors and a bypass capacitor are added to quickly pull down the feedback voltage of the amplifier circuit and to quickly discharge the output voltage of the voltage regulator through the discharge transistors. It has a low-noise feedback pull-low mechanism and an ability of fast disabling the operation. In addition, it can further lower the noise and reduce the discharge time and unnecessary power consumption. To sum up, it makes the voltage regulator circuit able to provide a low-noise, precise, and stable output voltage.

Further according to an additional embodiment of the present invention, utilizing two discharge transistors allows for a flexible and adjustable result in the transition of the disable mode. In particular, by utilizing two MOS transistors 41 and 42 respectively of an internal resistance $r_{41}$ and $r_{42}$, a flexible and adjustable result in the transition of the disable mode is allowed. For example, by having adjustable (i.e., different) sizes of the MOS transistors 41 and 42, while discharging from a loading capacitor CL, the voltage of the input of the amplifier circuit 32 ($VNA_2$) should be $r_{42}/(r_{42}+r_{41})*V_{NOUT}$, so that r41 and r42 are turn-on resistors of the two MOS transistors 41 and 42. By adjusting the size radio of two MOS transistors 41 and 42, (or adjusting the internal resistance $r_{41}$ and $r_{42}$ turn-on resistors r41 and r42 of the two MOS transistors r41 and r42,), the voltage of the feedback terminal, which is the input of the amplifier, can be controlled not to make the amplifier 202 function when the amplifier 202 is not immediately turned off by the enable signal. In other words, the voltage of the feedback terminal is not substantially lower than the reference voltage $V_{REF}$ and therefore the amplifier 202 does not function. The possible conflict of triggering charging operation during the discharging process is thereby prevented by utilizing two transistors 41, 42 according to the present invention. Therefore, the present invention provides a flexible and adjustable method in the transition of disable mode and improves the traditional voltage regulator by using two discharge transistors.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A voltage regulator circuit comprising:

an amplifier circuit comprising a first receiving terminal and a second receiving terminal for receiving a reference voltage and a feedback voltage respectively, the amplifier circuit outputting a driving voltage according to the reference voltage, the feedback voltage, and an enable signal;

an output transistor comprising three terminals electrically connected to the amplifier circuit, an output node, and a first voltage source respectively, the output transistor outputting a regulated voltage at the output node according to the driving voltage output by the amplifier and a voltage provided by the first voltage source;

a first discharge transistor having a first size and comprising three terminals electrically connected to a reverse enable signal, the output node, and a feedback node respectively, the first discharge transistor controlling whether or not the output node is electrically connected to the feedback node according to the reverse enable signal, wherein the feedback node is electrically connected to the second receiving terminal of the amplifier circuit for providing the amplifier circuit with the feedback voltage;

a second discharge transistor having a second size being different than the first size and comprising three terminals electrically connected to the reverse enable signal, the feedback node, and a second voltage source, the first discharge transistor controlling whether or not the feedback node is electrically connected to the second voltage source according to the reverse enable signal; and a loading module electrically connected to the output node, the feedback node, and the second voltage source.

2. The voltage regulator circuit of claim 1 further comprising at least a bypass capacitor electrically connected to the second receiving terminal of the amplifier circuit.

3. The voltage regulator circuit of claim 1 wherein the three terminals of each transistor comprise a gate, a drain, and a source, the gate of the output transistor is electrically connected to the amplifier circuit, the drain of the output transistor is electrically connected to the output node, the source of the output transistor is electrically connected to the first voltage source, the gate of the first discharge transistor is electrically connected to the reverse enable signal, the drain of the first discharge transistor is electrically connected to the output node, the source of the first discharge transistor is electrically connected to the feedback node, the gate of the second discharge transistor is electrically connected to the reverse enable signal, the drain of the second discharge transistor is electrically connected to the feedback node, and the source of the second discharge transistor is electrically connected to the second voltage source.

4. The voltage regulator circuit of claim 3 further comprising a terminative transistor, whose gate, drain, and source are electrically connected to the enable signal, the gate of the output transistor, and the first voltage source respectively, wherein the terminative transistor controls whether or not the driving voltage is electrically connected to the first voltage source according to the enable signal.

5. The voltage regulator circuit of claim 4 wherein when the enable signal disables the operation of the amplifier circuit and turns on the terminative transistor, the terminative transistor controls the driving voltage to turn off the output transistor to stop the output transistor from outputting the output voltage to the output node.

6. The voltage regulator circuit of claim 4 wherein the first discharge transistor and the second discharge transistor are N-channel MOS (NMOS) transistors, and the output transistor and the terminative transistor are P-channel MOS (PMOS) transistors.

7. The voltage regulator circuit of claim 3 wherein the loading module comprises:

a loading capacitor connected to the output node and the second voltage source;

a first loading resistor connected to the output node and the feedback node; and a second loading resistor connected to the feedback node and the second voltage source.

8. The voltage regulator circuit of claim 1 further comprising an inverter electrically connected to the gate of the first discharge transistor and the gate of the second discharge transistor for transforming the enable signal into the reverse enable signal and for outputting the reverse enable signal to the first discharge transistor and the second discharge transistor.

9. The voltage regulator circuit of claim 1 wherein the first voltage source is used for providing a high voltage level, and the second voltage source is used for providing a ground voltage or a low voltage level.

10. The voltage regulator circuit of claim 9 wherein when the enable signal disables the operation of the amplifier circuit, the driving voltage is used for turning off the output transistor to stop the output transistor from outputting the output voltage to the output node.

11. The voltage regulator circuit of claim 9 wherein when the enable signal disables the operation of the amplifier circuit, the reverse enable signal is used for turning on the first discharge transistor to connect the output node and the feedback node.

12. The voltage regulator circuit of claim 11 wherein when the enable signal disables the operation of the amplifier circuit, the reverse enable signal is used for turning on the second discharge transistor to connect the feedback node and the second voltage source so as to pull down the feedback voltage close to a voltage level provided by the second voltage source.

13. The voltage regulator circuit of claim 1 wherein the amplifier circuit is an operational amplifier or a differential amplifier.

14. A method for disabling a voltage regulator circuit, the voltage regulator circuit comprising an amplifier circuit for outputting a driving voltage according to a reference voltage, a feedback voltage on a feedback node, and an enable signal, an output transistor coupled among the amplifier circuit, a output node, and a first voltage source for regulating an output voltage at the output node; a first discharge transistor having a first size and coupled among the enable signal, the output node, and a feedback node; and a second discharge transistor having a second size being different than the first size coupled among the enable signal, the feedback node, and a second voltage source; and the method comprising:

(a) utilizing the enable signal to disable the operation of the amplifier circuit for turning off the output transistor so as to stop the output transistor from outputting an output voltage at the output node;

(b) in step (a), utilizing the enable signal for turning on the first discharge transistor to connect the output node and the feedback node; and (c) in step (a), utilizing the enable signal for turning on the second discharge transistor to connect the feedback node and the second voltage source.

15. The method of claim 14 wherein the amplifier circuit comprises a first receiving terminal and a second receiving terminal for respectively receiving the reference voltage and the feedback voltage, and the method further comprising:

(d) in step (c), pulling down the feedback voltage to the voltage level of the second voltage source when the second discharge transistor is turned on to connect the feedback node and the second voltage source.

16. The method of claim 14 wherein the regulator circuit further comprises a bypass capacitor electrically connected to the second receiving terminal of the amplifier circuit, and the method further comprises:

(e) in step (d), utilizing the bypass capacitor to suppress noise.

17. The method of claim 14 wherein the regulator circuit further comprises a terminative transistor coupled among the enable signal, the output transistor, and the first voltage source, and the method further comprises:

(f) in step (a), when the enable signal disables the amplifier circuit, turning on the terminative transistor for turning off the output transistor to stop the output node from being electrically connected to the first voltage source.

18. The method of claim 14 wherein the first voltage source is used for provide a high voltage level, and the second voltage source is used for providing a ground voltage or a low voltage level.

19. The method of claim 14 wherein the regulator circuit further comprises a loading module comprising:

a loading capacitor connected to the output node and the second voltage source;

a first loading resistor connected to the output node the feedback node; and a second loading resistor connected to the feedback node and the second voltage source.

20. The method of claim 14 wherein the regulator circuit further comprises an inverter electrically connected to the first discharge transistor and the second discharge transistor for transforming the enable signal into the reverse enable signal, and the method further comprises:

(g) in step (b), utilizing the reverse enable signal for turning on the first discharge transistor to connect the output node and the feedback node; and (h) in step (c), utilizing the reverse enable signal for turning on the second discharge transistor to connect the feedback node and the second voltage source.

21. The method of claim 14 wherein each of the output transistor, the first discharge transistor, and the second discharge transistor is a MOS transistor or a bipolar junction transistor (BJT).

22. The method of claim 21 wherein each of the first discharge transistor and the second discharge transistor is an N-channel MOS (NMOS) transistor, and the output transistor is a P-channel MOS (PMOS) transistor.

23. The method of claim 22 wherein the gate of the output transistor is electrically connected to the amplifier circuit, the drain of the output transistor is electrically connected to the first voltage source, the gate of the first discharge transistor is electrically connected to the enable signal, the drain of the first discharge transistor is electrically connected to the output node, the source of the first discharge transistor is electrically connected to the feedback node, the gate of the second discharge transistor is electrically connected to the enable signal, the drain of the second discharge transistor is electrically connected to the feedback node, and the source of the second discharge transistor is electrically connected to the second voltage source.

24. The method of claim 14 wherein the amplifier circuit is an operational amplifier or a differential amplifier.

* * * * *

UNITED STATES PATENT AND TRADEMARK OFFICE

CERTIFICATE OF CORRECTION

PATENT NO. : 7,397,227 B2
APPLICATION NO. : 11/383763
DATED : July 8, 2008
INVENTOR(S) : Ling-Wei Ke et al.

It is certified that error appears in the above-identified patent and that said Letters Patent is hereby corrected as shown below:

In the Claims

Column 9, lines 33-34, replace the words “the first discharge transistor” with -- the second discharge transistor --.

Signed and Sealed this
Second Day of June, 2015

Michelle K. Lee

Michelle K. Lee
*Director of the United States Patent and Trademark Office*